US009418806B2

(12) United States Patent
Parashar

(10) Patent No.: US 9,418,806 B2
(45) Date of Patent: Aug. 16, 2016

(54) POWER SWITCHING APPARATUS

(75) Inventor: Rama Shankar Parashar, Staffordshire (GB)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 14/124,674

(22) PCT Filed: Jun. 7, 2011

(86) PCT No.: PCT/EP2011/059400

§ 371 (c)(1),
(2), (4) Date: Feb. 28, 2014

(87) PCT Pub. No.: WO2012/167818

PCT Pub. Date: Dec. 13, 2012

(65) Prior Publication Data

US 2014/0224769 A1 Aug. 14, 2014

(51) Int. Cl.
*H01H 33/666* (2006.01)
*H01H 33/00* (2006.01)
*H01H 33/664* (2006.01)

(52) U.S. Cl.
CPC ..... *H01H 33/6661* (2013.01); *H01H 33/002* (2013.01); *H01H 33/664* (2013.01); *H01H 33/6642* (2013.01); *H01H 33/6646* (2013.01)

(58) Field of Classification Search
CPC ..... H01H 33/12; H01H 33/6641; H01H 33/6642; H01H 33/6644; H01H 33/666; H01H 33/661; H01H 33/59; H01H 33/02; H01H 33/664; H01H 33/6646
USPC ..... 218/10, 11, 13, 57, 123, 127, 128, 129, 218/154
See application file for complete search history.

(56) References Cited

U.S. PATENT DOCUMENTS 3,369,094 A 2/1968 Langberg et al.
3,702,911 A * 11/1972 Schonhuber ..... 218/123

(Continued)

FOREIGN PATENT DOCUMENTS

CN 1452776 A 10/2003
CN 1776854 A 5/2006

(Continued)

OTHER PUBLICATIONS

International Search Report and Written Opinion in International Application No. PCT/EP2011/059400, mailed Feb. 22, 2012.

(Continued)

*Primary Examiner* — Truc Nguyen
*Assistant Examiner* — William Bolton
(74) *Attorney, Agent, or Firm* — Nixon Peabody LLP; Khaled Shami

(57) ABSTRACT

A power switching apparatus comprising a vacuum interrupter assembly and a switching assembly connected in parallel between a pair of terminals, each of the terminals being connectable in use to an electrical circuit. The vacuum interrupter assembly includes at least one vacuum interrupter having a pair of electrically conductive rods connected at a first end to a respective one of the terminals and extending at a second end into a vacuum tight enclosure. A first electrode is mounted at or near the second end of a first of the electrically conductive rods and a slotted coil including a support base mounted at or near the second end of a second of the electrically conductive rods. A second electrode is mounted on an inner surface of the slotted coil and a third electrode is mounted on the support base. The second ends of the electrically conductive rods extend into the vacuum tight enclosure such that the first and third electrodes define opposed contact surfaces and at least one of the electrically conductive rods is movable relative to the other to open or close a gap between the opposed contact surfaces. The switching assembly includes at least one crossed-field plasma discharge switch that does not carry any current in its open state and conducts and carries current in its closed state. The switching assembly is controllable to switch between open and closed states to modify, in use of the power switching apparatus, a current flowing through the vacuum interrupter assembly.

10 Claims, 3 Drawing Sheets

(56) References Cited

U.S. PATENT DOCUMENTS

| | | | | |
|---|---|---|---|---|
| 4,130,781 | A | 12/1978 | Dethlefsen | |
| 5,212,425 | A * | 5/1993 | Goebel et al. | 315/111.21 |
| 5,336,975 | A | 8/1994 | Goebel et al. | |
| 2004/0040935 | A1 * | 3/2004 | Heimbach et al. | 218/7 |
| 2013/0002392 | A1 | 1/2013 | Parashar et al. | |
| 2013/0015161 | A1 | 1/2013 | Parashar | |

FOREIGN PATENT DOCUMENTS

| | | |
|---|---|---|
| DE | 41 21 685 | 1/1993 |
| EP | 0 386 710 | 9/1990 |
| JP | 44-3927 | 2/1969 |
| JP | 63-304543 | 12/1988 |
| JP | 06-215700 | 5/1994 |
| JP | 2005-332721 | 12/2005 |

OTHER PUBLICATIONS

Office Action issued in Japanese Patent Application No. 2014-513919 mailed Feb. 17, 2015, including an English translation, 7 pages total.

Chinese Office Action for Chinese Application No. 201180071317.9, dated Jun. 10, 2015, 6 pages.

* cited by examiner

POWER SWITCHING APPARATUS

CROSS REFERENCE TO RELATED APPLICATIONS

This application is the national stage of International Application No. PCT/EP2011/059400, filed Jun. 7, 2011, entitled, "Power Switching Apparatus," the contents of which are incorporated herein by reference in its entirety.

TECHNICAL FIELD

This invention relates to a power switching apparatus.

BACKGROUND

The operation of multi-terminal high voltage direct current (HVDC) transmission and distribution networks involves load and fault/short-circuit current switching operations. The availability of switching components to perform such switching permits flexibility in the planning and design of HVDC applications such as parallel HVDC lines with a tap-off line or a closed loop circuit.

A known solution for load and fault/short-circuit current switching is the use of semiconductor-based switches, which are typically used in point-to-point high power HVDC transmission. The use of semiconductor-based switches results in faster switching and smaller values of let-through fault current. The disadvantages of using such switches however include high forward losses, sensitivity to transients and the lack of tangible isolation when the devices are in their off-state.

Another known solution for load and fault/short-circuit current switching is a vacuum interrupter. The operation of the vacuum interrupter relies on the mechanical separation of electrically conductive contacts to open the associated electrical circuit. Such a vacuum interrupter is capable of allowing high magnitude of continuous AC current with a high short-circuit current interrupting capability.

The conventional vacuum interrupter however exhibits poor performance in interrupting DC current because of the absence of current zero. Although it is feasible to use the conventional vacuum interrupter to interrupt low DC currents up to a few hundred amperes due to the instability of an arc at low currents, such a method is not only unreliable but is also incompatible with the levels of current typically found in HVDC applications.

It is possible to carry out DC current interruption using conventional vacuum interrupters by applying a forced current zero or artificially creating a current zero. This method of DC current interruption involves connecting an auxiliary circuit in parallel across the conventional vacuum interrupter, the auxiliary circuit comprising a capacitor, a combination of a capacitor and an inductor or any other oscillatory circuit. The auxiliary circuit remains isolated by a spark gap during normal operation of the vacuum interrupter.

When the contacts of the vacuum interrupter begin to separate, the spark ignition gap is switched on to introduce an oscillatory current of sufficient magnitude across the vacuum interrupter and thereby force the current across the interrupter to pass through a current zero. This allows the vacuum interrupter to successfully interrupt the DC current. Such an arrangement however becomes complex, costly and space consuming due to the need to integrate the additional components of the auxiliary circuit.

OVERVIEW

According to an aspect of the invention there is provided a power switching apparatus comprising a vacuum interrupter assembly and a switching assembly connected in parallel between a pair of terminals, each of the terminals being connectable, in use, to an electrical circuit, wherein: the vacuum interrupter assembly includes at least one vacuum interrupter having first and second electrically conductive rods connected at a first end to a respective one of the terminals and extending at a second end into a vacuum-tight enclosure, a first electrode being mounted at or near the second end of a first of the electrically conductive rods and a slotted coil including a support base being mounted at or near the second end of a second of the electrically conductive rods, a second electrode being mounted on an inner surface of the slotted coil and a third electrode mounted on the support base, the second ends of the electrically conductive rods extending into the vacuum-tight enclosure such that the first and third electrodes define opposed contact surfaces and at least one of the electrically conductive rods is movable relative to the other electrically conductive rods to open or close a gap between the opposed contact surfaces; and the switching assembly includes at least one crossed-field plasma discharge switch that does not carry any current in its open state and conducts and carries current in its closed state, the switching assembly being controllable to switch between open and closed states, in use of the power switching apparatus, to modify a current flowing through the vacuum interrupter assembly.

The parallel connection of the vacuum interrupter and switching assemblies in the power switching apparatus has been found to improve current interruption carried out using the vacuum interrupter assembly.

The above arrangement of the first electrode and the slotted coil in the vacuum interrupter assembly enables the generation of a self-induced axial magnetic field that is perpendicular to the arc current drawn between the first and second electrodes during the current interruption process. In the presence of the axial magnetic field, the arc voltage begins to rise while the arc current begins to drop rapidly until it reaches a value lower than the chopping current value of the electrode material. At this point the current drops instantly to zero, which results in full dielectric recovery and successful current interruption. The generation of the self-induced axial magnetic field removes the need to incorporate additional equipment into the vacuum interrupter assembly in order to generate the required axial magnetic field and thereby reduces the complexity of the layout of the vacuum interrupter assembly.

The switching assembly provides additional control over the current interruption process by enabling modification of the size of current flowing through the vacuum interrupter assembly during the current interruption process. For example, the size of current can be altered to minimise any adverse effects of high current densities on the electrodes to thereby improve the lifetime of the vacuum interrupter assembly.

The crossed-field plasma switch has rapid switching capability and can support a high voltage drop in its open state. This in turn renders the crossed-field plasma switch compatible for use in the switching assembly to aid current interruption in high voltage applications.

The parallel connection of the vacuum interrupter and switching assemblies in the power switching apparatus also results in a simple layout of the power switching apparatus, which in turn reduces the manufacturing and installation costs of such an apparatus.

The shape of the slotted coil and the material of each electrode may vary, depending on the design requirements of the vacuum interrupter. The slotted coil may, for example, includes either only a single slot, which preferably extends around the full perimeter of the coil, or a plurality of slots, while each electrode may, for example, be made from a refractory material, which may be selected from a group of chromium-chromium, copper-tungsten, copper tungsten carbide, tungsten, chromium or molybdenum.

In embodiments of the invention the switching assembly may be controllable to switch from an open state to a closed state in response to a formation of a gap between the opposed contact surfaces of the or each vacuum interrupter.

During normal operation, current only flows through the vacuum interrupter while the switching assembly remains in an open state and therefore does not conduct current. As soon as a gap between the opposed contact surfaces is formed, the switching assembly is switched to a closed state to divert part of the flow of current through the switching assembly. This not only limits the arc voltage across the or each vacuum interrupter, but also reduces the current density at the opposed contact surfaces to thereby minimise the damage to the opposed contact surfaces during the stage when the length of the gap is still very small and the current is flowing through molten globules of electrode material.

The power switching apparatus preferably further includes a control circuit, the control circuit being controllable to generate a control signal in response to the formation of the gap between the opposed contact surfaces of the or each vacuum interrupter and transmit the control signal to the switching assembly, the switching assembly being controllable to switch between a closed state and an open state in response to the control signal received from the control circuit.

The use of such a control circuit enables the switching assembly to respond rapidly and automatically to the formation of the gap between the opposed contact surfaces of the or each vacuum interrupter.

The switching assembly is preferably controllable to switch from an open state to a closed state at a predetermined length of the gap following the formation of the gap between the opposed contact surfaces of the or each vacuum interrupter.

Once the gap between the opposed contact surfaces reaches a sufficiently large length, current begins to flow transversely between the first and second electrodes. At this stage the switching assembly is switched back to an open state so that all of the current flows through the vacuum interrupter. This in turn allows the axial magnetic field generated in the slotted coil to act on all of the current flowing through the or each vacuum interrupter.

The switching assembly may be controllable to switch from an open state to a closed state at a predetermined level of current prior to the extinguishing of current in the or each vacuum interrupter and may be controllable to switch from a closed state to an open state following the extinguishing of current in the or each vacuum interrupter.

In the presence of the axial magnetic field, the arc voltage begins to rise while the arc current begins to drop rapidly until it reaches a value lower than the chopping current value of the electrode material. Switching the switching assembly to a closed state in the moments prior to the current being extinguished diverts the flow of any residual current through the switching assembly. The switching assembly is then switched to an open state to complete the current interruption process.

Such operation of the power switching apparatus not only allows each electrode to be made from material that are conducive to the high dielectric withstand requirements in the vacuum interrupter during open condition, but also has lower chopping current value which reduces any overvoltage generated during the current interruption process.

The number and arrangement of vacuum interrupters in the vacuum interrupter assembly may vary, depending on the design requirements of the power switching apparatus. The vacuum interrupter assembly may, for example, include a plurality of series-connected and/or parallel-connected vacuum interrupters.

Multiple vacuum interrupters may be connected to define different configurations of the vacuum interrupter assembly in order to vary its operating voltage and current characteristics to match the requirements of the associated power application.

As with the vacuum interrupter assembly, multiple crossed-field plasma discharge switches may be connected to define different configurations of the switching assembly in order to vary its operating voltage and current characteristics to match the requirements of the associated power application.

In embodiments where the switching assembly includes a plurality of parallel-connected crossed-field plasma discharge switches, the switching assembly may be controllable to sequentially open or close the plurality of parallel-connected crossed-field plasma discharge switches.

Sequentially opening and closing the plurality of parallel-connected crossed-field plasma discharge switches allows discharge to be maintained in at least one crossed-field plasma discharge switch for a longer duration and thereby increases the overall duration of current conduction in the switching assembly. This in turn renders the switching assembly compatible for use in current interruption processes in which the time taken to initially separate the opposed contact surfaces and the time taken to diffuse the arc is longer than the allowed duration of current conduction in a single crossed-field plasma discharge switch.

Examples of applications that are compatible with the power switching apparatus according to the invention include, for example, AC power networks, AC high voltage circuit breakers, AC generator circuit breakers, railway traction, ships, superconducting magnetic storage devices, high energy fusion reactor experiments, stationary power applications, and high voltage direct current (HVDC) multi-terminal networks.

BRIEF DESCRIPTION OF THE DRAWINGS

Preferred embodiments of the invention will now be described, by way of non-limiting examples, with reference to the accompanying drawings in which.

DESCRIPTION OF EXAMPLE EMBODIMENTS

Figure 1:
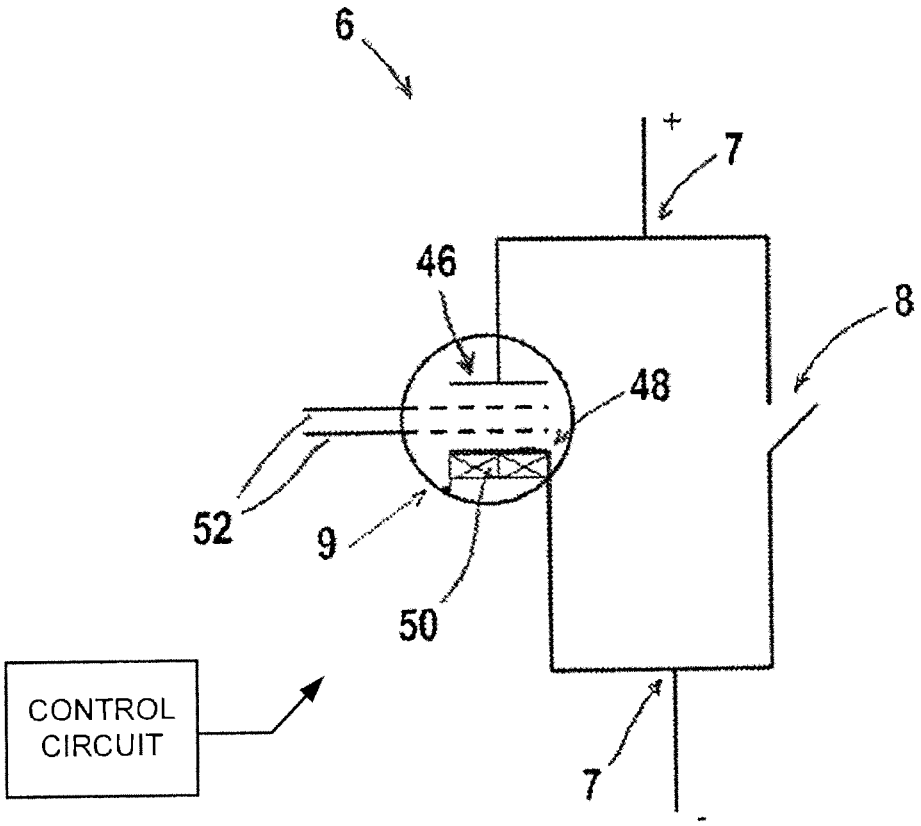
FIG. 1 shows a power switching apparatus according to an embodiment of the invention.
Figure 2:
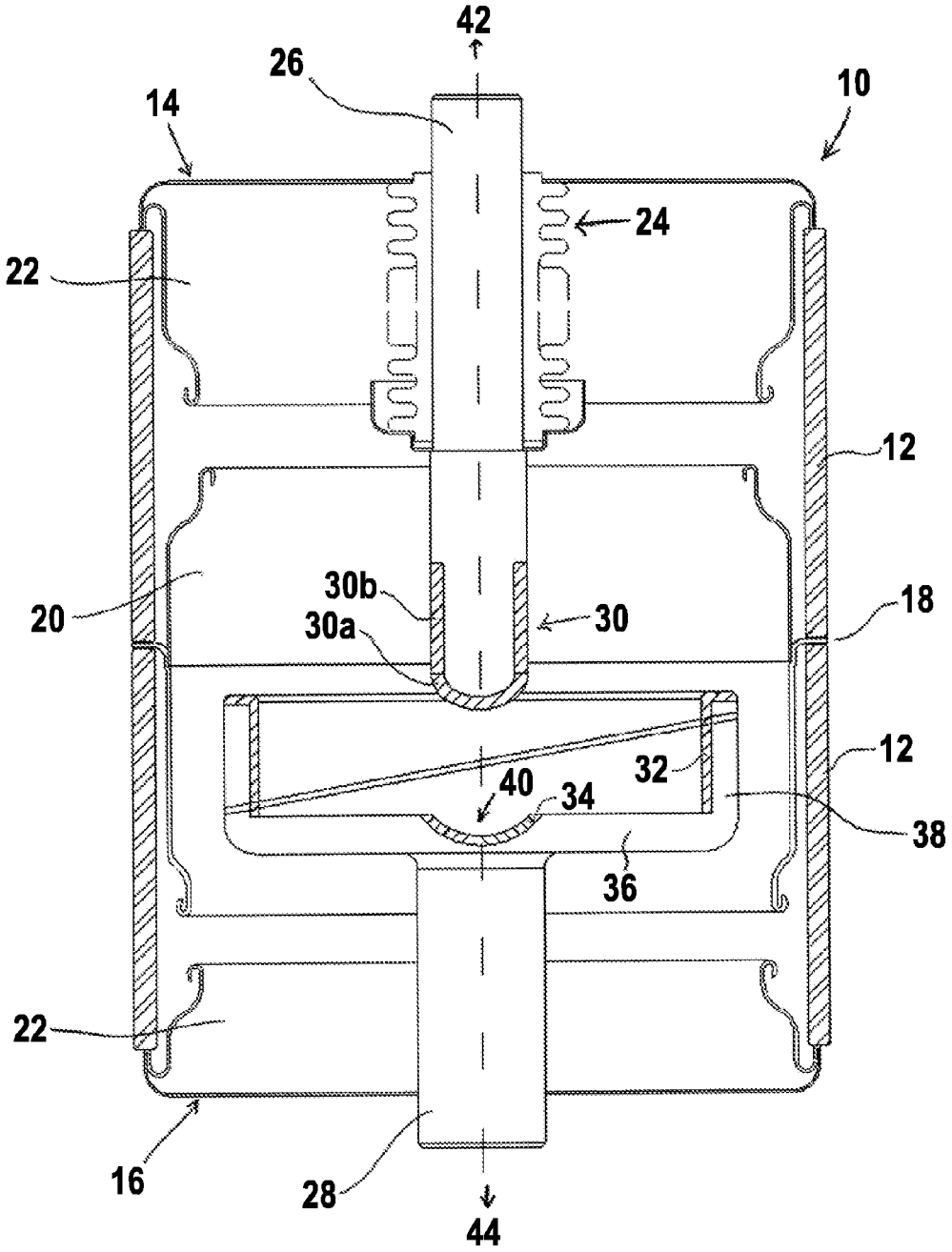
FIG. 2 shows a vacuum interrupter assembly that forms part of the power switching apparatus of FIG. 1.

A power switching apparatus 6 according to an embodiment of the invention is shown in FIG. 1.

The power switching apparatus 6 comprises a pair of terminals 7, a vacuum interrupter assembly 8, a switching assembly 9 and a control circuit (not shown).

The vacuum interrupter assembly 8 is connected in parallel with the switching assembly 9 between the terminals 7.

In use, the terminals are respectively connected to positive and negative terminals of a DC electrical circuit.

The vacuum interrupter assembly 8 comprises a single vacuum interrupter 10.

The vacuum interrupter 10 includes a pair of cylindrical housings 12, first and second end flanges 14,16 and an annular structure 18 assembled to define a vacuum-tight enclosure. Each end flange 14,16 is brazed to a first end of a respective cylindrical housing 12 to form a hermetic joint. The two cylindrical housings 12 are joined together at their second ends via the annular structure 18. The annular structure 18 includes a central shield 20 that overlaps inner walls of the cylindrical housings 12 to protect the inner walls of the cylindrical housings 12 from metal vapour deposition arising from arc discharge, while each end flange 14,16 includes an end shield 22 to improve the electrostatic field line distribution along the length of the vacuum interrupter 10.

Each cylindrical housing 12 is metallised and nickel-plated at both ends. The length and diameter of the respective cylindrical housing 12 varies depending on the operating voltage rating of the vacuum interrupter 10, while the dimensions and shape of the first and second end flanges 14,16 and the annular structure 18 may vary to correspond to the size and shape of the cylindrical housings 12.

The vacuum interrupter 10 also includes a tubular bellows 24 and first and second electrically conductive rods 26,28.

The first end flange 14 includes a hollow bore dimensioned to accommodate the tubular bellows 24, while the second end flange 16 includes a hollow bore dimensioned to accommodate the second rod 28 within its hollow bore. The tubular bellows 24 also includes a hollow bore for retention of the first rod 26.

The first and second rods 26,28 are respectively retained within the hollow bores of the tubular bellows 24 and the second end flange 16 so that the second ends of the rods 26,28 are located inside the enclosure and the first ends of the rods 26,28 are located outside the enclosure. The first and second rods 26,28 may be fabricated from, for example, oxygen-free high conductivity (OFHC) copper.

The vacuum interrupter 10 further includes first, second and third electrodes 30,32,34, and a multiple slotted coil 38. The multiple slotted coil 38 includes a plurality of slots (not shown).

It is envisaged that, in other embodiments, the multiple slotted coil may be replaced by a slotted coil that includes only a single slot. Preferably such a single slot would extend completely around the full perimeter, e.g. the circumference of the coil.

The first electrode 30 consists of first and second electrode portions 30*a*,30*b*. The first electrode portion 30*a* is in the form of a rounded electrode portion that is mounted at the second end of the first rod 26. The second electrode portion 30*b* is in the form of a annular electrode portion that is mounted around the circumference of the first rod 26 and is adjacent to the first electrode portion 30*a*.

The second electrode 32 is mounted on an inner surface of the multiple slotted coil 38.

The multiple slotted coil 38 includes a support base 36. The support base 36 is mounted at the second end of the second rod 28.

The third electrode 34 is mounted at the centre of the support base 36. The rods 26,28 are coaxially aligned so that the first and third electrodes 30,34 define opposed contact surfaces. The third electrode 34 includes a recess 40 for receipt of the first electrode portion 30*a* and the shape of the recess 40 corresponds to the shape of the rounded first electrode portion 30*a* so as to maximise contact between the first and third electrodes 30,34.

Each electrode 30,32,34 is made from a refractory material, which may be selected from a group of, for example, chromium-chromium, copper-tungsten, copper tungsten carbide, tungsten, chromium or molybdenum. These refractory materials not only exhibit excellent electrical conductivity, but also display high dielectric strength subsequent to the current interruption. Moreover, these refractory materials have relatively high chopping current values, which helps to rapidly extinguish the arc once the current has dropped below the chopping current value.

Corrugated walls of the tubular bellows 24 allow the tubular bellows 24 to undergo expansion or contraction so as to increase or decrease the tubular length of the tubular bellows 24. This allows the first rod 26 to move relative to the second rod 28 between a first position where the first and third electrodes 30,34 are kept in contact, and a second position where only a portion of the first electrode portion 30*a* remains located inside the multiple slotted coil 38. The second rod 28 is kept at a fixed position.

In use, the first ends of the first and second rods 26, 28 are respectively connected to the terminals 7 of the power switching apparatus 6 so that the first end of the first rod 26 is connected to the positive terminal 42 of the DC electrical circuit, while the first end of the second rod 28 is connected to the negative terminal 44 of the DC electrical circuit.

The switching assembly 9 includes a crossed-field plasma discharge switch.

The crossed-field plasma discharge switch includes an anode 46, a cathode 48, crossed-field magnets 50 and two grid electrodes 52. The grid electrodes 52 are located between the anode 46 and the cathode 48, the grid electrodes 52 being respectively adjacent to the anode 46 and the cathode 48. The crossed-field magnets 50 are controlled to maintain a cold cathode discharge between the cathode 48 and the grid electrode 52 to the cathode.

The switching assembly 9 is in an open state and therefore does not conduct current when the grid electrode 52 adjacent to the anode 46 is maintained at a lower anode voltage to prevent electrons from passing through. The switching assembly 9 is in a closed state and therefore conducts current when the potential of the grid electrode 52 is increased to match the potential of the anode 46 to permit electrons to pass through.

Examples of crossed-field plasma discharge switches and their operation are described in U.S. Pat. No. 5,336,975.

The crossed-field plasma switch has rapid switching capability and can support a high voltage drop in its open state. This in turn renders the crossed-field plasma switch compatible for use in the switching assembly to aid current interruption in high voltage applications.

During normal operation of the connected DC electrical circuit, the tubular bellows 24 is controlled to move the first rod 26 to the first position to bring the first and third electrodes 30,34 into contact. At the same time the crossed-field plasma discharge switch remains in an open state. This allows current to flow between the positive and negative terminals 42,44 of the connected DC electrical circuit via the electrically conductive rods 26,28 of the vacuum interrupter 10 whilst no current flows through the switching assembly 9. The low contact resistance resulting from the contact between the first and third electrodes 30,34 means that there is no flow of current through the multiple slotted coil 38.

In the event of a fault resulting in a high fault current flowing in the connected DC electrical circuit, the current must be interrupted in order to prevent the high fault current from damaging components of the DC electrical circuit. Interruption of the fault current permits isolation and subsequent repair of the fault in order to restore the DC electrical circuit to normal operating conditions.

The current interruption process is initiated by controlling the tubular bellows 24 to move the first rod 26 toward its second position so as to separate the opposed contact surfaces of the first and third electrodes 30,34. The separation of the opposed contact surfaces results in the formation of a gap between the first electrode 30 and the third electrode 34, which leads to the formation of an arc in this gap. The arc consists of metal vapour plasma, which continues to conduct the current flowing between the first and third electrodes 30,34.

The control circuit detects the formation of the gap between the opposed contact surfaces and generates a control signal that is subsequently transmitted to the switching assembly 9. Upon receipt of the control signal, the switching assembly 9 is controlled to switch from an open state to a closed state. The switching assembly 9 then begins to conduct current, which has the effect of diverting part of the current through the switching assembly 9.

The diversion of current flow through the switching assembly 9 not only limits the arc voltage across the vacuum interrupter 10, but also reduces the current density at the opposed contact surfaces to thereby minimise the damage to the opposed contact surfaces during the stage when the length of the gap is still very small and the current is flowing through molten globules of electrode material. This helps to minimise damage to the electrodes 30,34 during current interruption and thereby extend the lifetime of the vacuum interrupter 10.

As the gap between the opposed contact surfaces increases and the magnitude of current increases, the multiple slotted coil 38 begins to draw current via the second electrode 32. The shape of the multiple slotted coil 38 causes the drawn current to flow in a preferential direction within the multiple slotted coil 38, which results in generation of an axial magnetic field in the gap between the first electrode 30 and the second electrode 32. The direction of the generated axial magnetic field is perpendicular to the direction of current being drawn between the first electrode 30 and the second electrode 32.

When the gap increases to the point where the multiple slotted coil 38 begins to draw current, the switching assembly 9 is controlled to switch from a closed state to an open state. The switching assembly 9 then stops conducting current, which has the effect of causing all of the current to flow through the vacuum interrupter 10. This allows the axial magnetic field generated in the multiple slotted coil 38 to act on all of the current flowing through the power switching apparatus 6.

In the presence of the axial magnetic field, the metal vapour plasma is forced away from the gap between the first electrode 30 and the second and third electrodes 32,34. Subsequently the arc voltage begins to rise while the magnitude of the drawn current begins to drop rapidly. When the magnitude of the drawn current reaches a value lower than the chopping current value of the electrode material, the arc energy becomes insufficient to sustain the current, which leads to the arc becoming highly unstable and the current dropping instantly to zero. This allows full dielectric recovery and successful current interruption to take place.

The duration of current interruption is limited by the time required to mechanically move the first rod 26 from the first position to the second position, which is typically a few milliseconds. Once the first rod 26 reaches the second position, the current will typically drop to zero in about 10 to 20 μs.

The arrangement of the first rod 26 and the multiple slotted coil 38 therefore allows the separation of the first and third electrodes 30,34 to result in the generation of a self-induced axial magnetic field to assist in the extinguishing of the arc formed between the first electrode 30 and the second and third electrodes 32,34. This removes the need to incorporate additional equipment into the vacuum interrupter assembly in order to generate the required axial magnetic field, and thereby reduces the complexity of the layout of the vacuum interrupter assembly.

The comparatively simpler layout of the vacuum interrupter assembly has the effect of reducing the amount of space required for the assembly and the associated installation costs, while the reduced number of components in the vacuum interrupter assembly improves the reliability of the current interruption process.

Optionally, prior to the extinguishing of current in the vacuum interrupter 10, the switching assembly may be controlled to switch from an open state to a closed state at a predetermined level of current. Switching the switching assembly 9 to a closed state in the moments prior to the current being extinguished diverts the flow of any residual current through the switching assembly 9. This allows the current to become zero across the vacuum interrupter open contacts. This is followed by the switching assembly 9 being controlled to switch back to an open state to complete the current interruption process.

Such operation of the power switching apparatus 6 not only allows each electrode 30,32,34 to be made from material that are conducive to the high dielectric withstand requirements in the vacuum interrupter 10 during open condition, but also has been found to reduce any overvoltage generated during the current interruption process.

The parallel connection of the vacuum interrupter and switching assemblies 8,9 in the power switching apparatus 6 has been found to improve current interruption carried out using the vacuum interrupter 10.

The switching assembly 9 provides additional control over the current interruption process by enabling modification of the size of current flowing through the vacuum interrupter 10 during the current interruption process.

The parallel connection of the vacuum interrupter and switching assemblies 8,9 in the power switching apparatus 6 also results in a simple layout of the power switching apparatus 6, which in turn reduces the manufacturing and installation costs of such an apparatus 6.

Figure 3:
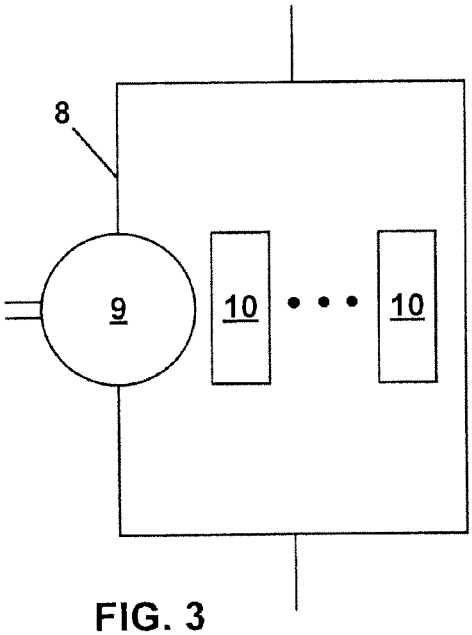
FIGS. 3 and 4 show a plurality of series-connected (FIG. 3) and/or parallel-connected (FIG. 4) vacuum interrupters.
Figure 4:
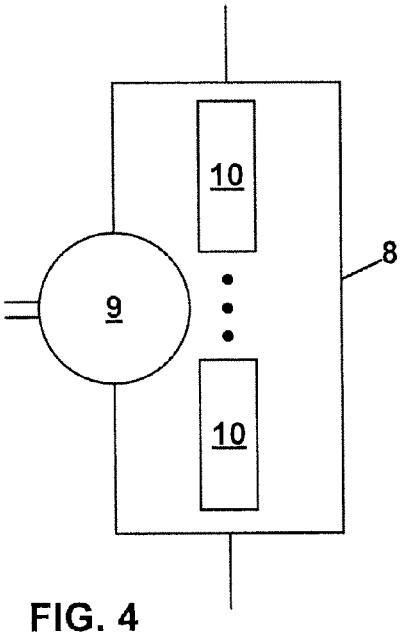

It is envisaged that, in other embodiments, the vacuum interrupter assembly may include a plurality of series-connected (FIG. 3) and/or parallel-connected (FIG. 4) vacuum interrupters.

Multiple vacuum interrupters may be connected to define different configurations of the vacuum interrupter assembly in order to vary its operating voltage and current characteristics to match the power requirements of the associated power application. For example, connecting multiple vacuum interrupters in series increases the dielectric strength of the vacuum interrupter assembly and thereby permits the use of the vacuum interrupter assembly at higher operating voltages, while connecting multiple vacuum interrupters in parallel permits the vacuum interrupter to interrupt higher levels of current.

Figure 5:
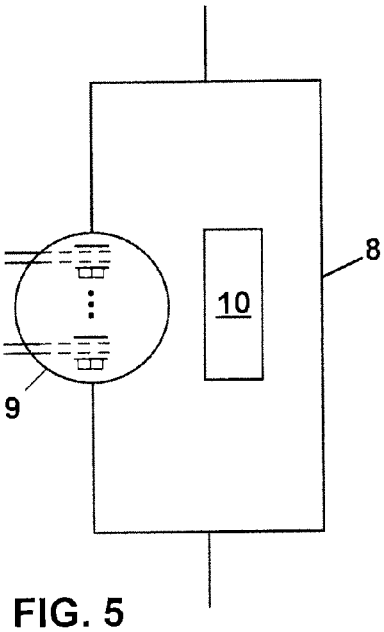
FIGS. 5 and 6 show a plurality of series-connected (FIG. 5) and/or parallel-connected (FIG. 6) crossed-field plasma discharge switches.
Figure 6:
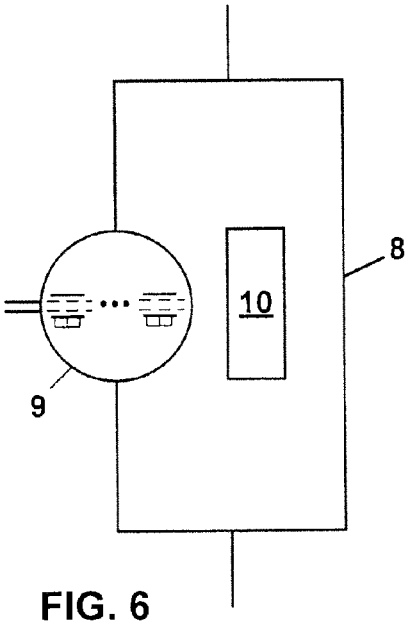

It is also envisaged that, in other embodiments, the switching assembly may include a plurality of series-connected (FIG. 5) and/or parallel-connected (FIG. 6) crossed-field plasma discharge switches.

As with the vacuum interrupter assembly, multiple crossed-field plasma discharge switches may be connected to define different configurations of the switching assembly in order to vary its operating voltage and current characteristics to match the power requirements of the associated power application.

For example, multiple vacuum interrupters and crossed-field plasma discharge switches can be connected in series and parallel to interrupt continuous current≥6 kA and short-circuit current≥100 kA at an operating voltage of≥400 kV of a HVDC multi-terminal network.

Depending on the opening speed of the rods 26,28 and the time taken to diffuse the arc, the maximum duration of conduction of the crossed-field plasma discharge switch is typically 1 to 3 ms.

The use of parallel-connected crossed-field plasma discharge switches in a switching assembly allows the plurality of parallel-connected crossed-field plasma discharge switches to be sequentially turned off/opened. This in turn allows discharge to be maintained in at least one cross-field plasma discharge switch for a longer duration and thereby increases the overall duration of current conduction in the switching assembly. This in turn renders the switching assembly compatible for use in current interruption processes in which the time taken to initially separate the opposed contact surfaces and the time taken to diffuse the arc is longer than the duration of current conduction in a single crossed-field plasma discharge switch.

The power switching apparatus of FIG. 1 is compatible for use, but is not limited to, applications such as AC power networks, AC high voltage circuit breakers, AC generator circuit breakers, railway traction, ships, superconducting magnetic storage devices, high energy fusion reactor experiments, stationary power applications, and high voltage direct current (HVDC) multi-terminal networks.

The invention claimed is:

1. A power switching apparatus comprising a vacuum interrupter assembly and a switching assembly connected in parallel between a pair of terminals, each of the terminals being connectable in use to an electrical circuit, wherein the vacuum interrupter assembly includes at least one vacuum interrupter having:

a pair of electrically conductive rods connected at a first end to a respective one of the terminals and extending at a second end into a vacuum tight enclosure, a first electrode mounted at or near the second end of a first of the electrically conductive rods, a slotted coil including a support base mounted at the second end of a second of the electrically conductive rods, a second electrode mounted on an inner surface of the slotted coil, and a third electrode mounted on the support base, the second ends of the electrically conductive rods extending into the vacuum tight enclosure such that the first and third electrodes define opposed contact surfaces and at least one of the electrically conductive rods is movable relative to the other to open or close a gap between the opposed contact surfaces, and wherein the switching assembly includes at least one crossed-field plasma discharge switch that does not carry any current in its open state and conducts and carries current in its closed state, the switching assembly being controllable to be switched into its closed state when current flows between the first and third electrodes through an arc present in a gap between the opposed contact surfaces of the at least one vacuum interrupter, thereby diverting part of the current flowing between the first and third electrodes through the arc.

2. The power switching apparatus according to claim 1 wherein the switching assembly is controllable to switch from its open state to its closed state in response to formation of the gap between the opposed contact surfaces of the at least one vacuum interrupter.

3. The power switching apparatus according to claim 2 further including a control circuit, the control circuit being controllable to generate a control signal in response to the formation of the gap between the opposed contact surfaces of the at least one vacuum interrupter and transmit the control signal to the switching assembly, the switching assembly being controllable to switch from its open state to its closed state in response to the control signal received from the control circuit.

4. The power switching apparatus according to claim 2 wherein the switching assembly is controllable to switch from its closed state to its open state at a predetermined length of the gap following the formation of the gap between the opposed contact surfaces of the at least one vacuum interrupter.

5. The power switching apparatus according to claim 4, wherein the switching assembly is controllable to switch from its open state to its closed state at a predetermined level of current prior to the extinguishing of current in the at least one vacuum interrupter and is controllable to switch from its closed state to its open state following the extinguishing of current in the at least one vacuum interrupter.

6. The power switching apparatus according to claim 1, wherein the vacuum interrupter assembly includes a plurality of series-connected and/or parallel-connected vacuum interrupters.

7. The power switching apparatus according to claim 1, wherein the switching assembly includes a plurality of series-connected and/or parallel-connected crossed-field plasma discharge switches.

8. The power switching apparatus according to claim 7, wherein the switching assembly includes a plurality of parallel-connected crossed-field plasma discharge switches, the switching assembly being controllable to sequentially turn off the plurality of parallel-connected crossed-field plasma discharge switches.

9. The power switching apparatus according to claim 1, wherein the first electrode consists of a first and second electrode portions, the first electrode portion being in the form of a rounded electrode portion that is mounted at the second end of the first of the electrically conductive rods, and the second electrode portion being in the form of an annular electrode portion that is mounted around the circumference of the first of the electrically conductive rods and is adjacent to the first electrode portion.

10. The power switching apparatus according to claim 9, wherein the third electrode includes a recess for receipt of the first electrode portion, the shape of the recess corresponding to the shape of the first electrode portion.

* * * * *